United States Patent [19]

Saji et al.

[11] 4,073,870

[45] Feb. 14, 1978

[54] PROCESS FOR PRODUCING CARBON FIBERS

[75] Inventors: Yasuo Saji; Hideo Kurioka, both of Mishima; Kozo Tanaka, Numazu; Hiroyasu Ogawa, Shizuoka, all of Japan

[73] Assignee: Toho Beslon Co., Ltd., Tokyo, Japan

[21] Appl. No.: 672,824

[22] Filed: Apr. 1, 1976

[30] Foreign Application Priority Data

Apr. 2, 1975 Japan ..... 50-39912

[51] Int. Cl.[2] ..... D01F 9/12

[52] U.S. Cl. ..... 423/447.6; 423/447.7; 423/447.8

[58] Field of Search ..... 423/447.2, 447.7, 447.8, 423/447.6, 447.9; 264/29.6, 29.7; 23/277 R

[56] References Cited

U.S. PATENT DOCUMENTS

| | | | |
|---|---|---|---|
| 3,607,672 | 9/1971 | Schmitt | 423/447.2 |
| 3,656,904 | 4/1972 | Ram | 423/447.7 |
| 3,673,035 | 4/1969 | Whitney | 264/29.7 |
| 3,772,429 | 11/1973 | Basche et al. | 423/447.7 |

FOREIGN PATENT DOCUMENTS

| | | | |
|---|---|---|---|
| 2,133,887 | 1/1973 | Germany | 423/447.7 |
| 4,726,964 | 7/1972 | Japan | 423/447.7 |
| 1,284,399 | 11/1969 | United Kingdom | 423/447.7 |

*Primary Examiner*—O. R. Vertiz
*Assistant Examiner*—Wayne A. Langel
*Attorney, Agent, or Firm*—Sughrue, Rothwell, Mion, Zinn and Macpeak

[57] ABSTRACT

A process for producing carbon fibers which comprises feeding an inert gas into a vertical furnace at about 500 to about 1,000° C and into a transverse furnace at about 800 to about 2,000° C connected thereto so that the inert gas flows from the transverse furnace toward the bottom of the vertical furnace and then to the top of the vertical furnace, and feeding preoxidized fibers from the top of the vertical furnace to pass the fibers countercurrent to the inert gas flow through the two furnaces to thereby carbonize the fibers. Apparatus of the type shown in the drawing for the production of carbon fibers by the above process. Carbon fibers having good performance can be produced with good efficiency.

10 Claims, 1 Drawing Figure

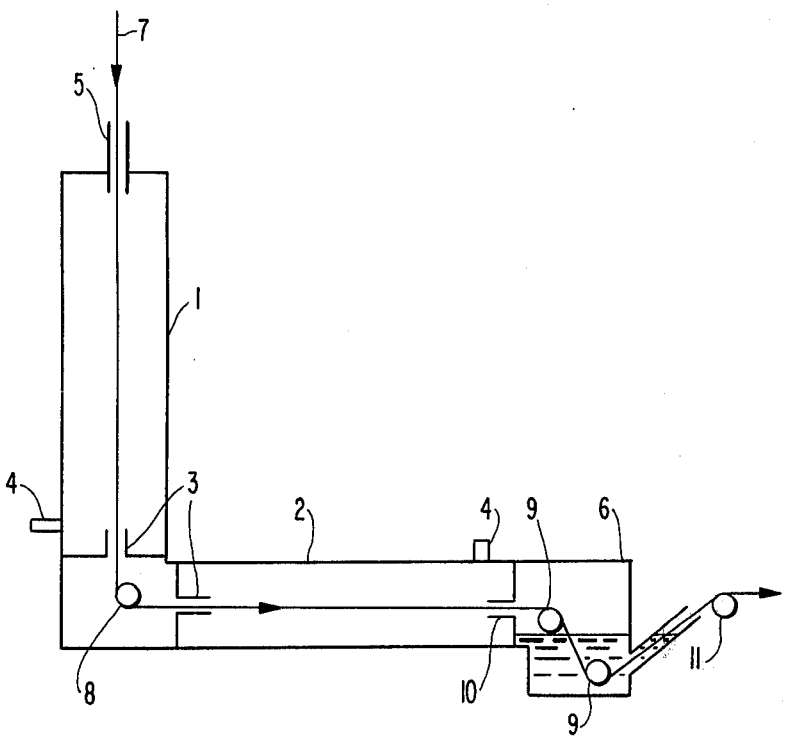
7
5
1
4
3
2
4
9
6
8
10
9
11

PROCESS FOR PRODUCING CARBON FIBERS

BACKGROUND OF THE INVENTION

1. Field of the Invention

This invention relates to a process and an apparatus for producing carbon fibers having good performance with good production efficiency.

2. Description of the Prior Art

Carbon fibers obtained by preoxidizing and carbonizing fibers of organic polymers such as regenerated cellulose fibers or polyacrylonitrile fibers under specified conditions have found a variety of applications, for example, as reinforcing materials for composite materials because of their high tenacity, high Young's modulus, low specific gravity, chemical resistance and other superior properties, as described in detail, for example, in M. Langley "Carbon Fibres in Engineering", McGraw-Hill Book Co., (U.K.) Limited., 1973.

Usually, carbon fibers are produced by first preoxidizing fibers of organic polymers at 200° to 300° C in air or in an atmosphere of another oxidizing gas, and then carbonizing the preoxidized fibers at 1,000° to 2,000° C in an atmosphere of an inert gas such as nitrogen or argon.

In order to obtain high performance carbon fibers, various improvements have been proposed in the art in the choice of the composition of the starting polymer and in the prescription of the conditions for the preoxidation and carbonization, such as the ambient atmosphere, the temperature, the time, and the tension of fibers, and improvements have also been made in changing batch processes to continuous processes.

Since in the early stage of carbonization, high amounts of volatile components are generated which cause process troubles as a result of becoming tarry, it is especially important to prevent such from occurring. It is also important to remove oxygen from the ambient atmosphere using the minimum amount of an inert gas, and also to prevent the breakage of fiber strands and the consequent occurrence of fiber fuzz during the production of carbon fibers.

SUMMARY OF THE INVENTION

It is one object of this invention to provide a process and an apparatus for producing carbon fibers which prevent the problems ascribable to volatile components that are generated and become tarry in carbonizing preoxidized fibers.

Another object of this invention is to provide a process and an apparatus for producing carbon fibers which enables one to exclude oxygen from the ambient atmosphere using a minimum amount of an inert gas in carbonizing preoxidized fibers.

Still another object of this invention is to provide a process and an apparatus for producing carbon fibers which prevent the breakage of fiber strands or the occurrence of fuzz during carbonizing preoxidized fibers.

We noted that in the step of carbonization, the generation of volatile components caused by chemical changes in the preoxidized fibers is mostly completed at the relatively low temperature range of about 500° to about 1,000° C, and a subsequent relatively high temperature treatment at about 800° to about 2,000° C is required to improve the physical properties, such as tenacity and modulus of elasticity, of carbon fibers. Based thereon, we attempted to perform the volatilization in a low temperature furnace and the carbonization in a high temperature furnace, and performed investigations as to the arrangement of the furnaces, the method of introducing an inert gas, the method of sealing the inlet and outlet, etc., which would be most suitable for a two furnace system. These investigations finally led to the present invention.

The present invention provides a process for producing carbon fibers which comprises feeding an inert gas into a vertical furnace at about 500° to about 1,000° C and into a transverse furnace at about 800° to about 2,000° C, which furnaces are connected, so that the inert gas flows from the transverse furnace toward the bottom of the vertical furnace and then to the top of the vertical furnace, and feeding preoxidized fibers from the top of the vertical furnace to pass the fibers countercurrent to the inert gas flow through the two furnaces, to thereby carbonize the fibers; and an apparatus for the production of carbon fibers by the above process which is of the type shown in the accompanying drawing. According to the present invention, carbon fibers having good performance can be produced with good production efficiency.

The apparatus for performing the above process is briefly of the following structure. A furnace for the continuous carbonization of preoxidized fibers is divided into a vertical furnace capable of being heated at about 500° to about 1,000° C and a transverse furnace capable of being heated at about 800° to about 2,000° C, both of which are connected at the bottom of the vertical furnace through at least one slit. The vertical furnace includes an open slit at its top for feeding fibers and discharging inert gas and gases generated from the fibers. An outlet for fibers which has a seal to prevent the entry of gases from the exterior is provided at one end of the transverse furnace. A feed inlet for inert gas is provided at a position near the downstream end (with respect to the advancing direction of the fibers) of each furnace so that the inert gas flow moves in a direction countercurrent to the direction of fiber movement.

BRIEF DESCRIPTION OF THE DRAWING

The FIGURE is a schematic view of the apparatus of this invention.

DETAILED DESCRIPTION OF THE INVENTION

Preoxidized fibers, as are referred to in the present invention, are fibers which are obtained by heating organic polymer fibers in an oxidizing atmosphere and do not burn in air by means of a match flame. The organic polymer fibers are, for example, regenerated cellulose fibers and polyacrylonitrile fibers. Polyacrylonitrile fibers are in wide use for the production of carbon fibers. Suitable polyacrylonitrile fibers are those of a homopolymer of acrylonitrile and a copolymer of at least about 90% by weight of acrylonitrile and a vinyl monomer copolymerizable therewith, for example, an acrylic ester (for example, methyl acrylate and butyl acrylate), methacrylic ester (for example, methyl methacrylate), vinyl acetate, acrylamide, N-methylolacrylamide, acrylic acid, methacrylic acid, vinylsulfonic acid, allylsulfonic acid, methallylsulfonic acid, and salts of such acids, usually, the sodium salt. As one skilled in the art will appreciate, the molecular weight of the fibers treated in accordance with the present invention is not important, and molecular weights such as are conventionally utilized in the art are processed with success in accordance with this invention.

As will be appreciated by one skilled in the art, the size of fibers treated in accordance with the present invention is not especially limited. However, certain size fibers are typically encountered in commercial usage, and these generally comprise a strand of about 100 to about 500,000 filaments, where a single filament will have a size on the order of about 0.5 to about 10 denier.

The oxidizing gas used in this invention includes air or a gas containing at least about 15% by volume of oxygen, for example, a mixture of air and oxygen. The preoxidizing heating treatment temperature is generally about 200° to about 300° C, and the heat treatment time is typically on the order of about 1 to about 5 hours. Fibers so treated are generally called preoxidized fibers, and this treatment is generally termed a "preoxidation", as is described in detail, for example, in U.S. Pat. Nos. 3,285,696 and 3,412,062. By processing in this manner, usually polyacrylonitrile which contains a starting oxygen content of from 0 to about 3 weight % (the latter being for a copolymer) will exhibit an increased oxygen content of from about 5 to about 15 weight %, preferably 8 to 12% by weight.

The present invention is further described below by reference to the FIGURE accompanying the present application. The apparatus usable in the present invention is, however, not limited to the type illustrated in the drawing.

The FIGURE shows the carbonization furnace, the introduction of preoxidized fibers, and the withdrawal of carbonized fibers. Reference numeral 1 represents a vertical furnace (which can also be called a low temperature furnace), and 2 a transverse furnace (which can also be called a high temperature furnace). These vertical and transverse furnaces make up the main body of the carbonization furnace. The vertical furnace and the transverse furnace are connected in an L-shape (that is, at substantially right angles to each other) through slits 3. The vertical and transverse furnaces include inert gas feed openings 4 and 4', respectively. The fiber inlet area of the vertical furnace is slit 5, and the heated inert gas flow is also jetted out from this open slit. The fiber outlet of the transverse furnace comprises liquid seal means 6 which prevents the inflow of the outer atmosphere. Also shown in optional outlet slit 10. In operation, preoxidized fibers 7 are introduced into the vertical furnace and passed into the transverse furnace. Volatile components (for example, ammonia gas, carbon dioxide gas, hydrocarbons and other gases in the case of polyacrylonitrile fibers) are generated by the chemical reaction of the preoxidized fibers. These volatile components are entrained in the upward flow of the inert gas and discharged out of the system from the slit 5. At this time, some of the volatile components sometimes condense as tar at the slit 5. Adhesion of the tar to the fibers could cause fiber breakage. In order to avoid this, the slit is held at a temperature of about 200° to about 400° C to thereby prevent condensation of the tar, for example, by providing an electric heater at the slit or circulating a heating medium therearound.

In the vertical furnace, the fibers are treated until the fibers attain a carbon content of more than about 75% by weight. Typically, and taking polyacrylonitrile fibers as illustrative, the preoxidized fibers will contain on the order of about 60 to about 65% by weight carbon (the percent of carbon with respect to the starting fiber is somewhat reduced by the preoxidation due to the decomposition of the CN group), the polyacrylonitrile fibers following passage through the vertical furnace will contain more than about 75% by weight carbon and the polyacrylonitrile fibers following passage through the transverse furnace will contain an increased carbon content of more than about 85% by weight carbon. The fibers are then transferred to the transverse furnace, wherein there is scarcely any generation of volatile components. Further, since the fibers have a fairly high Young's modulus, they do not sag at their center during their longitudinal advance through the transverse furnace.

The fibers treated in the transverse furnace are recovered as carbon fibers through the liquid seal means 6. During the entire process within the main body of the carbonization furnace, the advancing direction of the fibers treated is countercurrent to the direction in which the inert gas flows, and the volatile components generated from the fibers are discharged from the system together with the inert gas.

The vertical and transverse furnaces are maintained at about 500° to about 1,000° C, and about 800° to about 2,000° C, respectively. In each of the furnaces, the temperature need not always be the same throughout the furnace ranging from the fiber inlet to the fiber outlet, but the temperature may be made higher gradually or stepwise toward the outlet, for example, taking the vertical furnace as illustrative, the first third of the vertical furnace can be maintained at 500° C, the middle third of the vertical furnace maintained at 600° C, and the last third of the vertical furnace maintained at 700° C by the provision of appropriate heating means. A similar procedure can be utilized in the transverse furnace, if desired. Preferably, the temperature of the vertical furnace as a whole is lower than that of the transverse furnace, and the temperature of the transverse furnace is generally above about 1,000° C. Most preferably, the temperature in the vertical furnace is maintained at from about 500° to a temperature less than 1,000° C whereas the temperature in the transverse furnace is maintained at a temperature about 1,000° C to about 2,000° C.

The inert gases used in this invention are non-oxidizing gases, and, generally, nitrogen or argon is used. The oxygen content of the inert gas should be less than about 100 ppm, preferably less than 30 ppm. As one skilled in the art will appreciate, mixtures of inert gases can, of course, be used. While not limitative, if one utilizes from about 1 to about 19 liters of inert gas per gram of fiber being processed, excellent results are achieved by processing in accordance with the present invention.

Generally, the vertical furnace is disposed perpendicular, but it may be inclined to an extent such that does not cause any troubles in interfering with the effects of this invention. The transverse furnace is generally disposed horizontal, but likewise, may be inclined to some extent. Generally, these two furnaces are arranged substantially at right angles to each other.

An opening for feeding an inert gas is provided generally near the outlet for fibers in each of these furnaces. It may however be spaced apart from the outlet so long as the gas flow is in a direction opposite to the fiber advancing direction. Generally, in order to meet this requirement, the inert gas feed opening is provided in the second half of each of the furnaces.

The amount of the inert gas fed to the transverse furnace is such that it prevents the inflow of an oxidizing gas such as air into the transverse furnace and the backflow of gases from the vertical furnace, and can be optionally determined according, for example, to the size and structure of the furnace.

The amount of the gas fed into the vertical furnace is such that it permits the gases generated from the fibers to escape from the open slit at the top and prevents the inflow of air or other gases from this slit, and can be optionally determined according, for example, to the generated gases, the size and shape of the slit, and the size of the furnace. Generally, the amount of the inert gas fed into the vertical furnace is larger than the amount of the inert gas fed into the transverse furnace, and, in many cases, more than half of the inert gas used is fed into the vertical furnace.

The fiber inlet at the top of the vertical furnace is an open slit which also permits the discharging of the generated gases and the inert gas. The size and shape of the slit can vary according, for example, to the amount of fibers treated per pass and the amount of the generated gases, but should be determined so as to prevent the inflow of air from the exterior and not to cause the breakage of fibers.

The joining area between the vertical and transverse furnaces may be of any structure which includes at least one slit so as to prevent the backflow of the inert gas from the vertical furnace to the transverse furnace. In this regard, the sizes of the slit joining the vertical and transverse furnaces or the inlet and outlet slits are set in a conventional manner applying standard techniques well known in the art of fluid dynamics; typically, the slits are "oversized" to permit easy passage of the maximum size fiber therethrough without direct contact with the slits. Since the system is typically remained at a slight over-pressure, i.e., maintained at a pressure slightly in excess of atmospheric pressure, little problem is encountered insuring that undesired gases do not enter the system.

The outlet for recovering the fibers may be of any desired structure so long as it prohibits the inflow of gases In the present invention, it is suitable to seal with a liquid such as water, carbon tetrachloride or ethylene dichloride, so sizing of the outlet slit is not too important.

The speed of fiber advance within the vertical furnace varies according to the length and temperature of the furnace, but is desirably such that the generation of gases from the fibers is substantially completely performed within the vertical furnace. Generally, in the case of polyacrylonitrile fibers, the heat treatment within the vertical furnace is performed until their carbon content becomes at least about 75% by weight, as a result of gas generation. Usually, periods of about 30 seconds to about 30 minutes are required for this treatment. In similar fashion, the speed of fiber advance within the transverse furnace varies according to the length and temperature of the furnace, but, generally, the "residence time" of the fibers in the transverse furnace is from about 30 seconds to about 30 minutes.

The process and apparatus of the present invention can be applied to the carbonization treatment of fibers which exhibit the same behavior as preoxidized polyacrylonitrile fibers do in carbonization, and which illustrate the same problems to be solved in the carbonization treatment.

The following advantages are obtained by the process of this invention when preoxidized fibers are heat treated at about 500° to about 1,000° C in the vertical furnace while feeding the fibers from the top toward the bottom thereof and supplying an inert gas upwardly from the bottom of the furnace.

1. Volatile components are generated in high quantities by the heat treatment in the vertical furnace at about 500° to about 1,000° C. In the case of polyacrylonitrile fibers or cellulosic fibers, the amount of the volatile components corresponds to an about 40 to about 50 weight % loss of the preoxidized fibers. It is important to discharge such high amounts of volatile components from the system without adhesion of tar. to the surface of the fibers or to the furnace wall. According to the present invention, the utilization of an upwardly advancing flow of a heated inert gas permits the volatile components to be discharged from the top of the furnace without condensation.

2. In the carbonization step, it is necessary to exclude oxygen from the ambient atmosphere. According to this invention, the fiber inlet slit is sealed utilizing an upwardly moving flow of inert gas to prevent the inflow of air from the inlet slit. Furthermore, the fibers can be fed continuously into the furnace.

3. The Young's modulus of preoxidized fibers increases with the progress of carbonization. In the initial stage of carbonization, the Young's modulus of the fibers is still low so that loosening tends to occur in fibers being advanced in the lateral direction. Since contact of the fibers with the furnace wall as a result of loosening may cause various process problems such as fiber breakage or the occurrence of fiber fuzz, special considerations, such as broadening of the width of the furnace to a great extent, become necessary. When a vertical furnace is used, fibers having a low Young's modulus can be advanced very smoothly.

4. The inert gas is fed from the bottom of the vertical furnace (i.e., from an opening or openings near the fiber outlet), and the fibers are advanced countercurrent to the inert gas flow through the vertical furnace. Since volatile components are generated in high amounts at the upper portion of the vertical furnace, this procedure makes it possible to discharge the volatile components smoothly out of the furnace.

The transverse furnace for treating the fibers at about 800° to about 2,000° C is connected to the vertical furnace, and an inert gas is fed from an opening or openings near the fiber outlet of the transverse furnace. This brings about the following advantages.

1. By directly connecting the vertical furnace to the transverse furnace, the inflow of air from the outlet and inlet of each of them is prevented.

2. There is hardly any generation of volatile components in the transverse furnace. In this furnace, it is necessary to heat the fibers at about 800 to about 2,000° C while preventing the inflow of oxygen. Since an upwardly moving flow of inert gas does not occur in the transverse furnace, the temperature can be easily maintained at the desired high temperature.

3. Since the carbon fibers that have left the vertical furnace have a somewhat increased Young's modulus, they do not sag even when advancing longitudinally through the transverse furnace.

4. Since the two furnaces are not laid together either vertically or transversely but are arranged in an L-shaped configuration to provide vertical and transverse furnaces, the lengthwise distance of the furnaces is short, and installation space is effectively utilized.

5. As is clear from the accompanying drawing, the inert gas is fed from at least one opening near the fiber outlet of the transverse furnace, flows to the fiber inlet of the transverse furnace, and via the fiber outlet and the fiber inlet of the vertical furnace, is discharged from the system. The flow of the inert gas is countercurrent to the advancing of the fibers. Since the inert gas flows smoothly in one direction, breakage of the fibers and the consequent occurrence of fiber fuzz in the fiber strands due to turbulent flow of the inert gas is prevented.

As described above, the process of this invention can be performed with good operability, and by continuously carbonizing preoxidized fibers by the process of this invention using the furnace described hereinabove, carbon fibers of good quality without the adhesion of tar can be obtained.

The following examples illustrate the present invention specifically.

EXAMPLE 1

Strands of polyacrylonitrile filaments (1.5 denier × 6,000 filaments) made of a copolymer of 98% by weight of acrylonitrile and 2% by weight of methyl acrylate (degree of polymerization about 1,450) were heated in the air at 250° C for 3 hours to form preoxidized filaments. Twnety strands of the preoxidized filaments were arranged in a row, and carbonized using the apparatus shown the FIGURE; both the vertical and the transverse furnaces were 30 cm wide, 10 cm in depth and had a length as described below where more details are provided on these furnaces.

The low temperature furnace (vertical furnace) had a length of 2 meters, and the inlet slit thereof was essentially disposed at the top of the vertical furnace and had a height in the vertical direction of 50 cm and an opening of 20 cm × 1 cm at the uppermost portion thereof to receive the preoxidized fiber strands. The temperature of the slit was maintained at 260° C by an electric band heater. Nitrogen at room temperature was fed at a rate of 20 liters/min. from an opening located 10 cm away from the fiber outlet slit of the low temperature furnace. The temperature of the interior of the furnace was maintained at 850° C.

The high temperature furnace (transverse furnace) had a length of 1.8 meters, and its fiber outlet was sealed with water as shown in the FIGURE Nitrogen at room temperature was fed at a rate of 10 liters/min. from an opening located 10 cm away from the fiber outlet slit of the high temperature furnace. The temperature of the interior of the furnace was maintained at 1,400° C.

Roller 8 is shown disposed at the area between the vertical furnace and the transverse furnace, which roller permits the direction of the travelling fibers to be changed from the vertical to the horizontal direction.

Also shown are rollers 9 in the liquid sealing means 6, which roller permits the fibers existing from the transverse furnace to be traversed through the liquid and then exiting from the apparatus.

Roller 11 is a take-off roller for removing the fibers from the apparatus.

As one skilled in the art would appreciated, while rollers are shown, other equivalent means can be used to assist in the transport of the fibers.

In this particular example, slit 3 essentially comprises two blocking walls at the end of the vertical furnace and at the entrance end of the transverse furnace with a slit therebetween having a length of 10 cm in the direction of fiber strand flow, a length of 20 cm in the direction tranverse the direction of fiber strand flow and a height of 3 cm in the direction perpendicular to the direction of fiber strand flow.

In this particular example, slit 3 was heated by an electric heater band.

Carbon fibers obtained by continuously carbonizing the twenty strands of the preoxidized filaments at a rate of 25 meters/hour had a monofilament diameter of 9.3 microns, a specific gravity of 1.7, a tenacity of 230 $Kg/mm^2$ and a modulus of elasticity of 23 $tons/mm^2$, and fuzz of the filaments was reduced. The degree of carbonization in the vertical furnace in this example was 87.5 weight % and, following passage through the transverse furnace (final product), the degree of carbonization was 95.2%.

EXAMPLE 2

Polyacrylonitrile fibers (0.8 denier × 12,000 filaments) made of a copolymer of 97% by weight acrylonitrile, 2% by weight methyl acrylate and 1% by weight sodium methallylsulfonate (degree of polymerization 1,600) were heated in the air at 265° C for 2.5 hours to produce strands of preoxidized filaments.

Thirty strands of the preoxidized polyacrylonitrile fibers were arranged in a row, and continuously carbonized using the apparatus used in Example 1.

The temperature of the outlet slit from the vertical furnace was maintained at 280° C. Nitrogen at room temperature was fed at rates of 18 liters/min. and 12 liters/min. to the low temperature furnace and the high temperature furnace, respectively. The temperatures of the interior of the furnaces were maintained at 800° C and 1,300° C, respectively.

In this example, the degree of carbonization following passage through the vertical furnace was 85 weight %, and the degree of carbonization (final product) following passage through the transverse furnace was 94 weight %.

Carbon fibers obtained by continuously carbonizing the thirty strands of preoxidized filaments at a rate of 28 meters/hour had a monofilament diameter of 7.1 microns, a specific gravity of 1.73, a tenacity of 260 $Kg/mm^2$ and a modulus of elasticity of 22 $tons/mm^2$, showing superior properties.

While the invention has been described in detail and with reference to specific embodiments thereof, it will be apparent to one skilled in the art that various changes and modifications can be made therein without departing from the spirit and scope thereof.

What is claimed is:

1. A process for producing carbon fibers which comprises feeding an inert gas into each of a vertical furnace maintained at about 500° C to about 1,000° C and a transverse furnace maintained at about 800° to about 2,000° C connected thereto so that the inert gas flows from the transverse furnace toward the bottom and then the top of the vertical furnace, and feeding preoxidized organic polymer fibers from the top of the vertical furnace to pass the fibers countercurrent to the inert gas flow through the two furnaces to thereby carbonize the fibers and obtain said carbon fibers, wherein:

during the entire process within the vertical and transverse furnace the advancing direction of the fibers treated is countercurrent to the direction in which the inert gas flows;

volatile components are generated in high amounts at the upper portion of the vertical furnace and there is substantially no generation of volatile components in the transverse furnace; and the feeding of the preoxidized fibers and the discharging of the inert gas containing the volatile components are carried out through the same slit whose temperature is maintained at about 200° to 400° C.

2. The process of claim 1 wherein said preoxidized fibers are obtained by heat treating polyacrylonitrile fibers, said polyacrylonitrile fibers being fibers of a homopolymer of acrylonitrile or a copolymer of at least about 90% by weight of acrylonitrile and a vinyl monomer copolymerizable therewith.

3. The process of claim 2 wherein the polyacrylonitrile fibers are heat treated in an oxidizing atmosphere at about 200° to about 300° C until their oxygen content becomes about 5 to about 15% by weight to thereby yield said preoxidized fiber.

4. The process of claim 2 wherein the vinyl monomer is a member selected from the group consisting of an acrylic ester, a methacrylic ester, vinyl acetate, acrylamide, N-methylolacrylamide, acrylic acid, methacrylic acid, vinylsulfonic acid, allylsulfonic acid, methallylsulfonic acid and salts of said acids.

5. The process of claim 1, wherein the generation of volatile components from preoxidized fibers is mostly completed in the temperature range of from about 500° to about 1000° C.

6. The process of claim 5, wherein said inert gas permits the volatile components to be discharged from the top of the vertical furnace without condensation.

7. The process of claim 1 wherein in the vertical furnace the preoxidized fibers are carbonized until their carbon content becomes at least about 75% by weight.

8. The process of claim 1 wherein said inert gas is nitrogen or argon.

9. The process of claim 1, wherein said preoxidized fibers are obtained by heat treating regenerated cellulose fibers.

10. The process of claim 1, wherein said vertical furnace and said transverse furnace are arranged substantially at right angles to each other.

* * * * *